US011332831B2

(12) United States Patent
Yamazaki et al.

(10) Patent No.: US 11,332,831 B2
(45) Date of Patent: May 17, 2022

(54) INSULATING COATING FOR ELECTRICAL STEEL SHEET

(71) Applicant: NIPPON STEEL & SUMITOMO METAL CORPORATION, Tokyo (JP)

(72) Inventors: Shuichi Yamazaki, Tokyo (JP); Masaru Takahashi, Tokyo (JP); Kazutoshi Takeda, Tokyo (JP); Hiroyasu Fujii, Tokyo (JP); Akira Akagi, Tokyo (JP); Hiroki Hori, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 690 days.

(21) Appl. No.: 15/576,944

(22) PCT Filed: Apr. 25, 2016

(86) PCT No.: PCT/JP2016/062938
§ 371 (c)(1),
(2) Date: Nov. 27, 2017

(87) PCT Pub. No.: WO2016/194520
PCT Pub. Date: Dec. 8, 2016

(65) Prior Publication Data

US 2018/0155840 A1 Jun. 7, 2018

(30) Foreign Application Priority Data

May 29, 2015 (JP) ..... JP2015-110055

(51) Int. Cl.
*C23C 22/22* (2006.01)
*C23C 22/12* (2006.01)
(Continued)

(52) U.S. Cl.
CPC ..... *C23C 22/22* (2013.01); *C21D 9/46* (2013.01); *C23C 22/08* (2013.01); *C23C 22/12* (2013.01);
(Continued)

(58) Field of Classification Search
CPC ..... C23C 22/00; C23C 22/07; C23C 22/12; C23C 22/20; C23C 22/22; C21D 9/46
(Continued)

(56) References Cited

FOREIGN PATENT DOCUMENTS

JP 53-028375 3/1978
JP 4-235287 A 8/1992
(Continued)

OTHER PUBLICATIONS

Sumitomo Metal Ind. JP 3 935664 B2, Machine Translation, Jun. 27, 2007, Entire Document (Year: 2007).*
(Continued)

*Primary Examiner* — Humera N. Sheikh
*Assistant Examiner* — Katherine A Christy
(74) *Attorney, Agent, or Firm* — Birch, Stewart, Kolasch & Birch, LLP

(57) ABSTRACT

An insulating coating for an electrical steel sheet is provided that is formed on a surface of a base metal of the electrical steel sheet and that contains a polyvalent metal phosphate of one or more elements selected from Al, Zn, Mg and Ca, and has an enriched layer of a divalent metal at an interface with the surface of the base metal. An enrichment of the divalent metal contained in the enriched layer is 0.01 g/m$^2$ or more and less than 0.2 g/m$^2$.

2 Claims, 7 Drawing Sheets

(51) Int. Cl.

| | |
|---|---|
| ***C23C 22/20*** | (2006.01) |
| ***C21D 9/46*** | (2006.01) |
| ***H01F 1/18*** | (2006.01) |
| ***C23C 22/74*** | (2006.01) |
| ***C23C 22/47*** | (2006.01) |
| ***C23C 22/26*** | (2006.01) |
| ***C23C 22/08*** | (2006.01) |

(52) U.S. Cl.
CPC ..... *C23C 22/20* (2013.01); *C23C 22/26* (2013.01); *C23C 22/47* (2013.01); *C23C 22/74* (2013.01); *H01F 1/18* (2013.01)

(58) Field of Classification Search
USPC ..... 428/689
See application file for complete search history.

(56) References Cited

FOREIGN PATENT DOCUMENTS

| | | | |
|---|---|---|---|
| JP | 05-078855 | | 3/1993 |
| JP | 06-330338 | | 11/1994 |
| JP | 11-131250 | | 5/1999 |
| JP | 11-152579 | | 6/1999 |
| JP | 11-158649 | A | 6/1999 |
| JP | 2001-107261 | | 4/2001 |
| JP | 2002-047576 | | 2/2002 |
| JP | 3385192 | B2 | 3/2003 |
| JP | 3935664 | B2 * | 6/2007 |
| JP | 2009-155707 | | 7/2009 |
| JP | 2010-261063 | | 11/2010 |
| JP | 2013-249486 | | 12/2013 |
| JP | 5596300 | B2 | 9/2014 |
| TW | 201343966 | | 11/2013 |
| WO | 2012/057168 | | 5/2012 |

OTHER PUBLICATIONS

Extended European Search Report dated Jul. 3, 2018, in European Patent Application No. 16802957.7.

International Preliminary Report on Patentability and English Translation of Written Opinion of the International Searching Authority dated Dec. 5, 2017 for PCT/JP2016/062938 (Forms PCT/IB/373 and PCT/ISA/237).

First Examination Report dated Mar. 31, 2019, issued in corresponding Indian Patent Application No. 201717045098.

First Office Action dated Mar. 4, 2019, issued in corresponding European Patent Application 16802957.7.

Korean Office Action dated Jun. 25, 2019, for Korean Application No. 10-2017-7034850, with English translation.

Brazilian Preliminary Office Action dated Feb. 5, 2020, for Brazilian Application No. 112017022937-4, with English translation.

* cited by examiner (a) Without adding a chelate compound NaCl concentration: 0.03%

(b) With adding a chelate compound NaCl concentration: 0.2%

INSULATING COATING FOR ELECTRICAL STEEL SHEET

TECHNICAL FIELD

The present invention relates to an insulating coating for an electrical steel sheet.

BACKGROUND ART

An insulating coating is generally formed on the surface of an electrical steel sheet (non-oriented electrical steel sheet and oriented electrical steel sheet) for the purpose of improving corrosion resistance. Conventionally, a chromate-based insulating coating that uses a bichromate as the main raw material is mainly adopted as the insulating coating. However, because hexavalent chromium is strongly toxic, from the viewpoint of protecting the working environment during production (hereunder, referred to as "environment protecting"), there is a demand for an insulating coating that does not contain chromium.

A phosphate-based insulating coating has been studied as an insulating coating to replace chromate-based insulating coatings (for example, see Patent Document 1). Further, various types of phosphate-based insulating coatings are currently being proposed (for example, see Patent Documents 2 to 5). However, chromate-based insulating coatings are still being adopted as insulating coatings for electrical steel sheets because, even when the thickness of the coating is thin, sufficient corrosion resistance is obtained and excellent weldability and interlocking performance can be secured.

A phosphate-based insulating coating (for example, an Al-phosphate-based insulating coating or an Mg—Al phosphate-based insulating coating) and an environment-friendly insulation coating that does not contain chromium (for example, a silica-based insulating coating or a Zr-based insulating coating) offer insufficient corrosion resistance in comparison to a chromate-based insulating coating. Corrosion resistance can be secured by making the thickness of the insulating coating thicker. However, if the film thickness is made thicker, there arises a problem of deteriorated weldability and interlocking performance.

In recent years, consumers have moved to Southeast Asia and Southern China which are regions with harsh corrosive environments, and electrical steel sheets are being exported to those regions also. Consequently, there is a demand for the insulating coating of electrical steel sheets that are to be exported to such regions with harsh corrosive environments to offer corrosion resistance that withstands a high air-borne salt environment during marine transportation and also withstands high-temperature and high-humidity environments at the local sites.

For example, Patent Documents 4 and 5 disclose results obtained when humidity cabinet tests were performed on insulating coatings that were baked at 170 to 300° C. and the corrosion resistance was then evaluated. Further, Patent Documents 6 and 7 disclose forming an insulating coating with a process liquid in which a synthetic resin is added to a phosphate compound and a chelating agent.

In addition, in Patent Document 8, an insulating coating with improved corrosion resistance under a wet environment is proposed, which is obtained by adding an organic resin made of a mixture or copolymer of one or more types among an acryl-based resin, an epoxy-based resin, and a polyester-based resin that have an average particle size of 0.05 μm to 0.50 μm and a copolymer of a fluoroolefin and an ethylenically unsaturated compound to a metal phosphate.

LIST OF PRIOR ART DOCUMENTS

Patent Document

Patent Document 1: JP53-028375
Patent Document 2: JP05-078855
Patent Document 3: JP06-330338
Patent Document 4: JP11-131250
Patent Document 5: JP11-152579
Patent Document 6: JP2001-107261
Patent Document 7; JP2002-047576
Patent Document 8: WO 2012/057168

SUMMARY OF INVENTION

Technical Problem

As described in the foregoing, although Patent Documents 4 and 5 disclose that humidity cabinet tests were performed on insulating coatings, more consideration needs to be given to evaluating the corrosion resistance in a high air-borne salt environment that is demanded for articles for export.

Further, although the insulating coatings disclosed in Patent Documents 6 and 7 are excellent in water resistance with respect to condensation water, the corrosion resistance of the insulating coatings under a high air-borne salt environment during marine transportation as well as under high-temperature and high-humidity environments corresponding to subtropical regions and tropical regions is unclear.

In addition, according to the technology disclosed in Patent Document 8, a thickness of 0.5 to 1.5 μm is described as a favorable thickness of the insulating coating, and the coating thickness in an example is 0.8 μm. The high level of weldability and interlocking performance that, in particular, are desired by users can be secured only in a region in which the thickness of the insulating coating is thinner. Therefore, to achieve an improvement in weldability and interlocking performance, it is required to make the thickness of the insulating coating thinner while maintaining excellent corrosion resistance.

Thus, because the corrosion resistance of environment-friendly insulation coatings including phosphate-based insulating coatings does not reach the level of chromate-based insulating coatings, currently chromate-based insulating coatings and environment-friendly insulation coatings coexist as insulating coatings for electrical steel sheets. Consequently, this leads to complexity with respect to product control and a decrease in productivity for both producers and users, and also puts pressure on profits.

In regard to environment-friendly insulation coatings, in addition to corrosion resistance, users attach importance also to performance with regard to the technical aspects of production, namely, weldability and interlocking performance, and demand a level of performance that is equivalent to the conventional chromate-based insulating coating.

An objective of the present invention is to provide an environment-friendly insulation coating for an electrical steel sheet that, even when having a film thickness of the same level as the thickness of a chromate-based insulating coating, exhibits excellent corrosion resistance, and in particular excellent corrosion resistance in a high air-borne salt environment during marine transportation and in high-temperature and high-humidity environments that correspond to subtropical regions and tropical regions.

Solution to Problem

The present invention has been completed based on the findings described above, and the gist of the present invention is an insulating coating for an electrical steel sheet that is described hereunder.

(1) An insulating coating for an electrical steel sheet that is formed on a surface of a base metal of the electrical steel sheet, wherein the insulating coating comprises a polyvalent metal phosphate of one or more elements selected from Al, Zn, Mg and Ca, and the insulating coating has an enriched layer of a divalent metal at an interface with the surface of the base metal, wherein an enrichment of the divalent metal contained in the enriched layer is 0.01 $g/m^2$ or more and less than 0.2 $g/m^2$.

(2) The insulating coating for an electrical steel sheet described in the above (1), wherein the insulating coating further contains an organic resin.

Advantageous Effects of Invention

According to the present invention, because excellent corrosion resistance can be secured even with a film thickness of the same level as the film thickness of a chromate-based insulating coating, an environment-friendly insulation coating for an electrical steel sheet that is excellent in weldability and interlocking performance can be obtained.

DESCRIPTION OF EMBODIMENTS

1. Regarding the Insulating Coating

An insulating coating according to the present invention is formed on the surface of a base metal of an electrical steel sheet. The type of base metal is not particularly limited, and a steel sheet having a chemical composition and a metal structure that is suited for use as a base metal of an oriented electrical steel sheet or a non-oriented electrical steel sheet can be used.

The insulating coating contains one or more types of polyvalent metal phosphate selected from Al, Zn, Mg and Ca, Specifically, aluminum mono-phosphate, zinc mono-phosphate, magnesium mono-phosphate and calcium mono-phosphate may be mentioned as examples of the polyvalent metal phosphate.

However, if the insulating coating merely contains the aforementioned components, adequate corrosion resistance, in particular, corrosion resistance that is required in a high air-borne salt environment during marine transportation as well as in high-temperature and high-humidity environments that correspond to subtropical regions and tropical regions is not obtained. Therefore, it is necessary to form an enriched layer of a divalent metal at an interface with the surface of the base metal in the insulating coating.

Because the aforementioned enriched layer has a dense structure and is firmly bonded to both a layer of the polyvalent metal phosphate and to the base metal, it is considered that the enriched layer improves the corrosion resistance and adhesiveness of the insulating coating and as a result significantly enhances the corrosion resistance.

However, if the enrichment of the divalent metal contained in the enriched layer (in the description hereafter, also referred to as simply "enrichment") is less than 0.010 $g/m^2$, continuity of the reaction layer of the divalent metal chelator will be lost and a corrosion resistance improving effect will not be obtained. On the other hand, if the enrichment is made 0.20 $g/m^2$ or more, the cost will be excessive and the economic efficiency will be poor. Accordingly, an enrichment that is 0.010 $g/m^2$ or more and less than 0.20 $g/m^2$ is adopted. From the viewpoint of improving corrosion resistance, preferably the enrichment is 0.020 $g/m^2$ or more, and from the viewpoint of economic efficiency, preferably the enrichment is 0.10 $g/m^2$ or less.

Note that, in the present invention, the enrichment of the divalent metal contained in the enriched layer is determined by a technique described hereunder. The technique will now be described in detail using a specific example.

Figure 1:
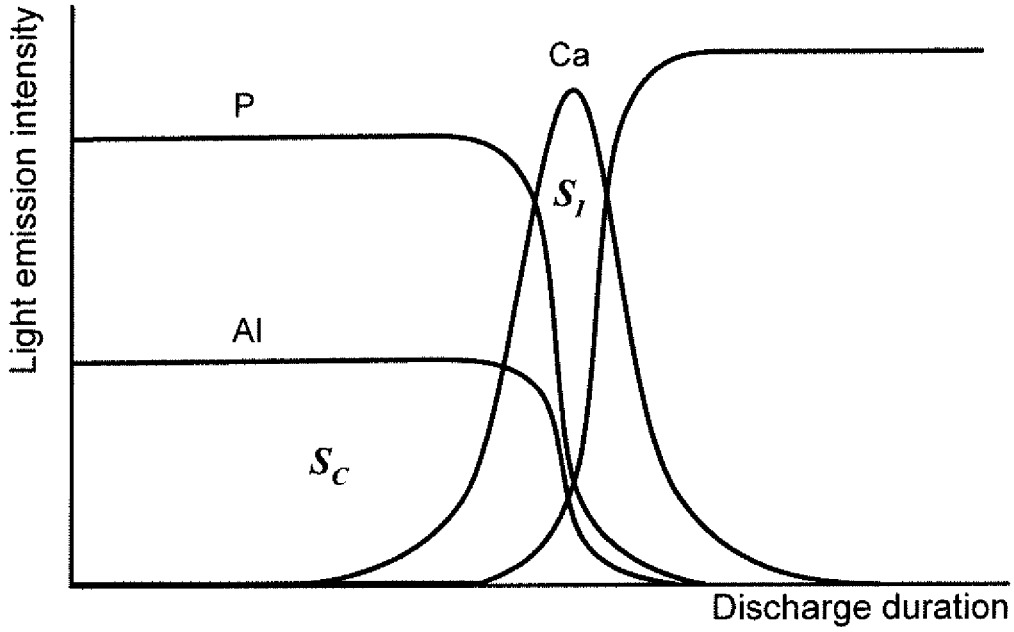
FIG. 1 is a graph illustrating an element concentration distribution in a coating thickness direction in a case where an aluminum phosphate and a Ca chelate compound are used.
Figure 2:
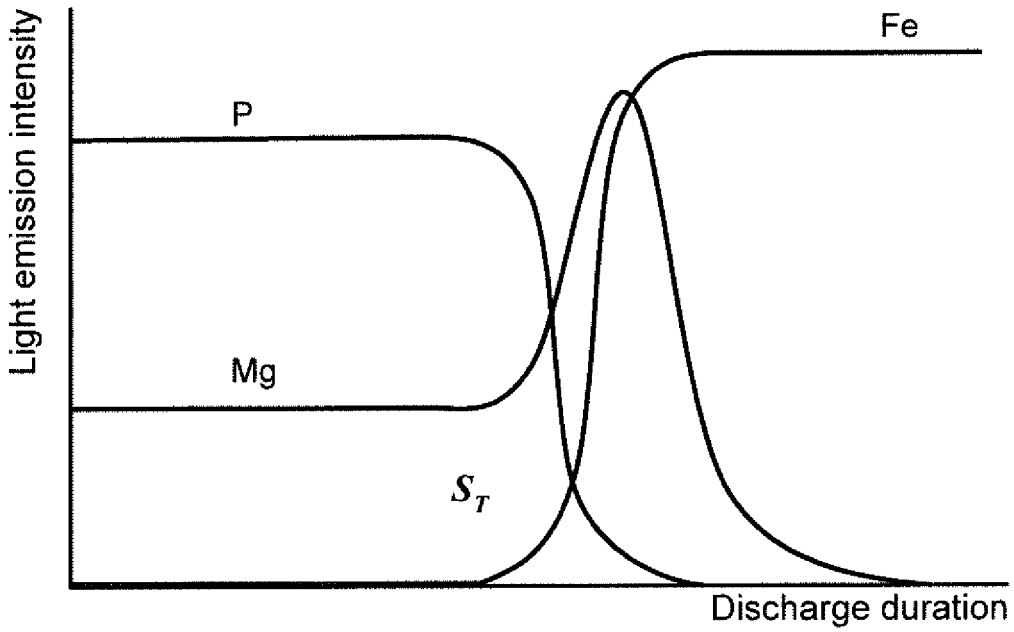
FIG. 2 is a graph illustrating an element concentration distribution in a coating thickness direction in a case where a magnesium phosphate and an Mg chelate compound are used.

First, the concentration distribution in the depth direction of P and each metallic component contained in the insulating coating is measured by glow discharge optical emission spectrometry (GDOES). An example of the measurement results is illustrated in FIGS. 1 and 2. In the figures, the ordinate represents the light emission intensity of the respective elements, and the abscissa represents the discharge duration. The light emission intensity is proportional to the concentration of each element, and the discharge duration corresponds to the depth direction position from the surface.

In the example illustrated in FIG. 1, the insulating coating contains aluminum mono-phosphate, and an enriched layer of Ca is formed. In such a case, a profile of a divalent metal that originates from the enriched layer and a profile of a divalent metal that originates from phosphate can be clearly distinguished.

Figure 3:
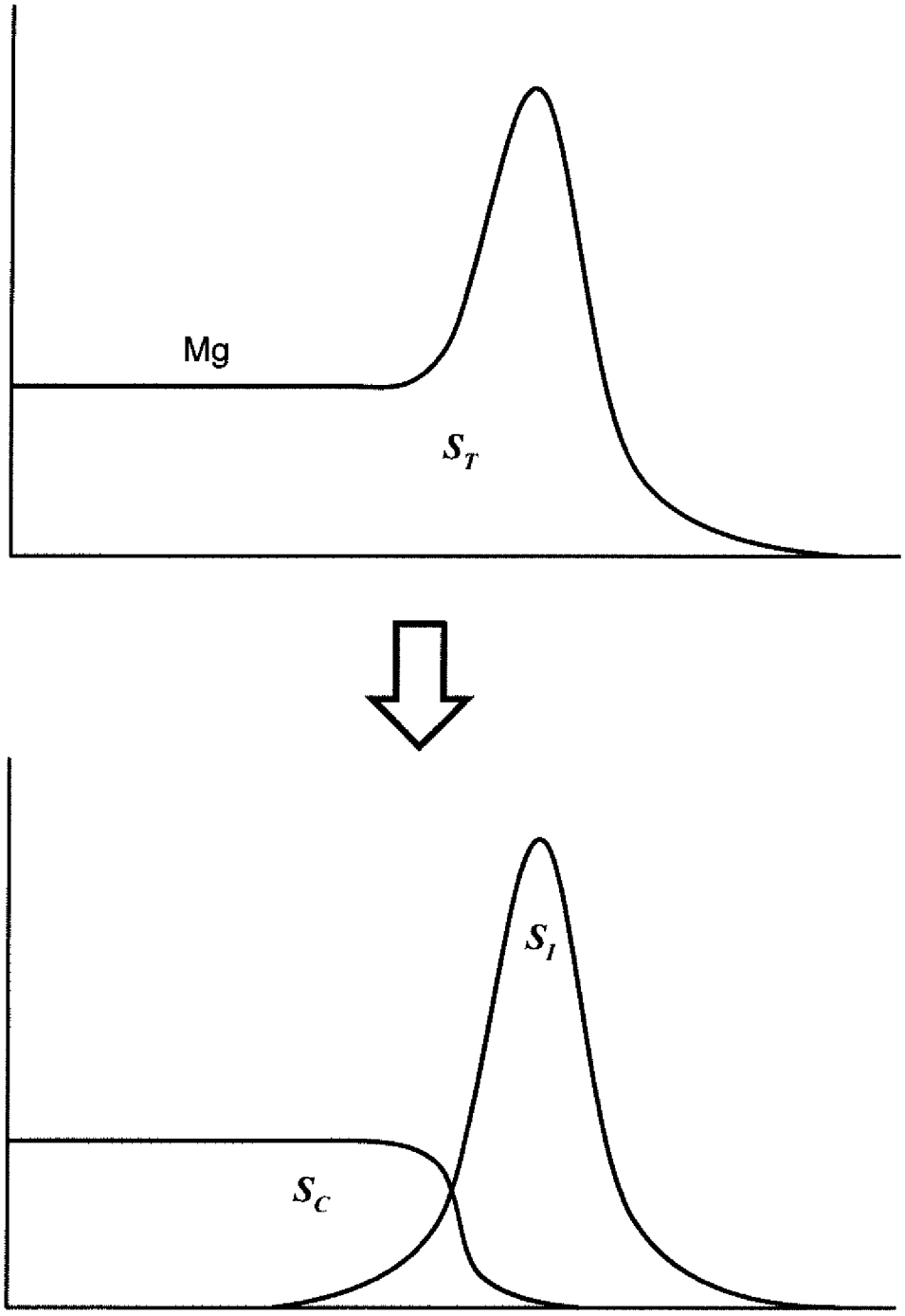
FIG. 3 is a view for describing a method for separating a peak of Mg originating from an enriched layer that is approximated with a Gaussian function from a depth-direction profile of Mg.

On the other hand, in the example illustrated in FIG. 2, the insulating coating contains magnesium mono-phosphate, and an enriched layer of Mg is formed. In such a case, as illustrated in FIG. 3, a peak of Mg originating from the enriched layer that is approximated by a Gaussian function is separated from the depth-direction profile of Mg, and the remainder thereof is taken as Mg originating from the phosphate.

It is possible to determine a ratio between the enrichment of the divalent metal contained in the enriched layer and the amount of the divalent metal contained in the insulating coating excluding the enriched layer based on areas ($S_I$ and $S_C$ in the drawings) that are framed by a curve indicated by the concentration profile that is separated by the above method and the ordinate and abscissa.

Next, by soaking a steel sheet having a predetermined area where the insulating coating is formed on the surface in a hot alkaline aqueous solution, only the insulating coating containing the enriched layer is selectively dissolved entirely. Subsequently, by using inductively coupled plasma atomic emission spectrophotometry (ICP-AES) to analyze the alkaline aqueous solution after the coating film dissolution treatment, a total divalent metal amount $M_T$ (g/m$^2$) contained in the insulating coating per unit area is determined.

It is possible to calculate an enrichment $M_I$ (g/m$^2$) of the divalent metal contained in the enriched layer based on the following formula (i).

$$M_I = M_T \times S_I / (S_I + S_C) \quad \text{(i)}$$

Where the meaning of each symbol in the formula is as follows:

$M_I$: enrichment (g/m$^2$) of divalent metal contained in the enriched layer;

$M_T$: total divalent metal amount (g/m$^2$) contained in the insulating coating;

$S_I$: area of concentration profile originating from enriched layer; and $S_C$: area of concentration profile originating from insulating coating excluding enriched layer.

Because the insulating coating contains the aforementioned components and also has the enriched layer, excellent corrosion resistance is obtained even if the film thickness is thin.

The insulating coating may also contain an organic resin. This is because, when subjecting an electrical steel sheet to punching, wear of the punching die is suppressed and the punching workability improves if an organic resin is contained in the insulating coating.

Although the type of organic resin is not particularly limited, a water-dispersible resin is preferable, and an acrylic resin, an acrylic styrene resin, an alkyd resin, a polyester resin, a silicone resin, a fluorocarbon resin, a polyolefin resin, a styrene resin, a polyvinyl acetate resin, an epoxy resin, a phenol resin, a urethane resin and a melamine resin may be mentioned as examples thereof.

2. Regarding Method for Producing Insulating Coating

Although a method for producing the insulating coating according to the present invention is not particularly limited, for example, an insulating coating having the composition described above can be produced by using the method described hereunder.

First, a coating liquid is prepared in which a polyvalent metal phosphate aqueous solution containing one or more elements selected from Al, Zn, Mg and Ca, and a chelate compound containing a divalent metal are mixed. The coating liquid is coated onto the surface of the base metal of the electrical steel sheet, and is thereafter baked to form an insulating coating. Note that, as described above, as necessary, an organic resin may be contained in the coating liquid.

For example, an aqueous solution containing one type or a combination of two or more types of aqueous solution selected from a aluminum mono-phosphate aqueous solution, a zinc mono-phosphate aqueous solution, a magnesium mono-phosphate aqueous solution and a calcium mono-phosphate and the like can be used as the polyvalent metal phosphate aqueous solution containing one or more types of metallic element selected from Al, Zn, Mg and Ca.

One or more elements selected from Mg, Ca, Sr, Ba, Zn and the like may be mentioned as the divalent metal contained in the chelate compound. Further, an oxycarboxylic acid-based, a dicarboxylic acid-based, or a phosphonic acid-based chelating agent or the like can be used as the chelate component.

Malic acid, glycolic acid and lactic acid may be mentioned as examples of the oxycarboxylic acid-based chelating agents. Oxalic acid, malonic acid and succinic acid may be mentioned as examples of the dicarboxylic acid-based chelating agents. Amino trimethylene phosphonic acid, hydroxyethylidene monophosphonic acid and hydroxyethylidene diphosphonic acid may be mentioned as examples of the phosphonic acid-based chelating agents.

Note that, when mixing the chelate compound with the phosphate aqueous solution, instead of separately adding the divalent metal and the chelating agent, it is preferable to add a compound in which the divalent metal and the chelating agent were compounded in advance. This is because, if the divalent metal and the chelating agent are added separately, there is a risk that the chelate and metal ions constituting the phosphate will react, and formation of the enriched layer of the divalent metal chelate will be insufficient.

It is considered that as a result of the chelate compound being included in the coating liquid in addition to the polyvalent metal phosphate aqueous solution, during the baking process a divalent metal M, a chelate component L and an iron component Fe in the base metal react to form an enriched layer of the divalent metal having an M-L-Fe bond at an interface between the coating film and the base metal.

At such time, to make the formation amount of the enriched layer fall within a predetermined range, it is preferable to set a compounding ratio m/l of an addition amount m (mol) of the divalent metal M to an addition amount l (mol) of the chelate component L in the chelate compound in an appropriate range. Specifically, it was found that by setting the value of the compounding ratio m/l in a range of 0.1 to 0.9, the enriched layer is favorably formed and the corrosion resistance of the insulating coating improves.

If the value of the compounding ratio m/l exceeds 0.9, that is, in a case where a chelate compound that is close to a saturated state in which a divalent metal constitutes a complex with almost all the chelate component is contained in the coating liquid, since a large portion of the chelate compound cannot react with Fe in the base metal, it is difficult for an enriched layer having an M-L-Fe bond to be formed. On the other hand, in a case where the value of compounding ratio m/l is less than 0.1, almost the entire amount of the chelate compound reacts with Fe in the base metal and $LFe_2$ is formed, and consequently an intended enriched layer having an M-L-Fe bond is reduced.

Although the amount of the chelate compound in the coating liquid is not particularly limited, for example, in a case where the formation amount of the entire insulating coating is 1 $g/m^2$, 1% by mass or more of the chelate compound with respect to the total amount of the polyvalent metal phosphate (anhydride converted) and organic resin can be added.

Next, favorable coating conditions and baking conditions will be described. Baking of the coating liquid is performed at a temperature of 250° C. or more, with the average rate of temperature increase (first rate of temperature increase) from the temperature of the base metal during coating, for example, room temperature of around 30° C., to 100° C. being set to 8° C./sec or more, and the average rate of temperature increase (second rate of temperature increase) from 150° C. to 250° C. being made lower than the first rate of temperature increase. Note that the temperature during coating is substantially equal to the temperature of the coating liquid.

The progress of association of the chelating agent stops if the flowability of the coating liquid ends. Therefore, to make the degree of association as low as possible, it is preferable to make the first rate of temperature increase up to 100° C., which is equal to the boiling point of water, high. If the first rate of temperature increase is less than 8° C./sec, it will be difficult for a crosslinking reaction to occur because the degree of association of the chelating agent while the temperature is rising will rapidly increase. Therefore, the first rate of temperature increase is set to 8° C./sec or more.

A crosslinking reaction between the phosphate and the chelating agent as well as degradation and volatilization of the chelating agent occur in a temperature range of 150° C. to 250° C. Therefore, by making the second rate of temperature increase small in the range from 150° C. to 250° C., a crosslinking reaction can be promoted while suppressing degradation of the chelating agent. However, a decrease in the rate of temperature increase may lead to a decrease in productivity.

On one hand, a crosslinking reaction of the chelating agent varies depending on the aforementioned degree of association of the chelating agent. Therefore, by making the first rate of temperature increase high and reducing the degree of association of the chelating agent in advance, even if the second rate of temperature increase is raised, a crosslinking reaction between the phosphate and the chelating agent can be promoted. On the other hand, in a case where the first rate of temperature increase is low and the degree of association of the chelating agent is large, unless the second rate of temperature increase is lowered in accordance therewith, a crosslinking reaction between the chelating agent and the phosphate cannot be caused to proceed sufficiently.

Studies conducted by the present inventors revealed that when the first rate of temperature increase is 8° C./see or more and the second rate of temperature increase is made lower than the first rate of temperature increase, a crosslinking reaction between the phosphate and the chelating agent proceeds according to the degree of association of the chelating agent, and excellent corrosion resistance is obtained. However, in a case where the second rate of temperature increase is excessively high, for example, more than 18° C./sec, even if the first rate of temperature increase is 8° C./sec or more, crosslinking is not adequately completed and excellent corrosion resistance is not obtained. Therefore, the second rate of temperature increase is preferably set to 18° C./sec or less. On the other hand, productivity decreases as the second rate of temperature increase becomes lower, and a decrease in productivity is noticeable when the second rate of temperature increase is less than 5° C./sec. Therefore, the second rate of temperature increase is preferably set to 5° C./sec or more.

3. Regarding Corrosion Resistance Evaluation Method

The present inventors conducted studies regarding an index for the corrosion resistance of an electrical steel sheet capable of enduring the aforementioned long-distance ocean transportation and usage under hot and humid climates. As a result of such studies, the present inventors adopted a method in which droplets (0.5 μL) of sodium chloride aqueous solutions of different concentrations are adhered to and dried on the surface of an electrical steel sheet having an insulating coating, the electrical steel sheet is held for a predetermined time period (48 hours) in a constant temperature and constant humidity state (50° C., RH 90%), and thereafter the corrosion state of the insulating coating is examined and evaluated based on a sodium chloride concentration at which rust does not occur.

The reason for adopting this evaluation method is as follows.

Until now, a humidity cabinet test as defined in JIS K 2246 has been used in some cases to evaluate the corrosion resistance of electrical steel sheets. In the aforementioned humidity cabinet test, the state of rust occurrence on the steel sheet surface is observed and evaluated after an electrical steel sheet is exposed for a predetermined time period in an atmosphere that is maintained at a temperature of 49° C. and a relative humidity of 95% or more.

However, even if the humidity cabinet test is applied to an electrical steel sheet having an insulating coating, in many cases corrosion is not observed. Therefore, with the humidity cabinet test it is difficult to determine the superiority or inferiority of the corrosion resistance of an insulating coating with respect to a high air-borne salt environment during marine transportation as well as high-temperature and high-humidity environments that correspond to subtropical regions and tropical regions.

On the other hand, a salt spray test defined in JIS Z 2371 is also a common corrosion resistance evaluation test. In this salt spray test, a 5% sodium chloride aqueous solution is adjusted to be predetermined spray quantity for a fixed time period in a thermostatic chamber that is maintained at 35° C., and thereafter salt spraying is performed onto a steel sheet surface for a predetermined time period, followed by observation and evaluation of the occurrence state of rust on the steel sheet.

When the salt spray test is applied to an electrical steel sheet having an insulating coating, corrosion occurs. However, the test environment of the salt spray test is different from the storage, transportation, and usage environments for an electrical steel sheet, such as an indoor warehouse on land or in the hold of a ship during exportation, because the salt spray test is conducted in a state in which the insulating coating is always in a wet state and is based on the assumption of corrosion in an environment in which the amount of air-borne salt is extremely large such as in the case of a salt damage environment for an automobile or an offshore structure. With respect to a test that combines salt spraying, wetting and drying steps that is described in Patent Document 8 also, the same situation applies if the salt spraying step is taken out.

During storage or usage of an electrical steel sheet, a state in which the electrical steel sheet is immersed in salt water or salt water is sprayed thereon and the surface is completely wetted by salt water does not arise under normal usage conditions. Further, with respect to corrosion that occurs when salt water is sprayed and corrosion that occurs in a corrosive environment (environment in which drying and high humidity are repeated) in an indoor warehouse on land or in the hold of a ship during exportation, the environments of the steel sheet surface during corrosion are different, and because of this the corrosion mechanisms are also different. Therefore, neither salt spraying nor a test that includes a salt spraying step are suitable for evaluating the corrosion resistance of an electrical steel sheet.

The present inventors conducted studies regarding a method that can properly evaluate the corrosion resistance of electrical steel sheets, and verified that the method described above is an appropriate, that is, a method (corrosion resistance testing method) in which droplets (0.5 μL) of sodium chloride aqueous solutions of different concentrations are caused to adhere to and dry on the surface of an electrical steel sheet having an insulating coating, the electrical steel sheet is then held for a predetermined time period (48 hours) in a constant temperature and constant humidity state (50° C., RH 90%), and thereafter the corrosion state of the insulating coating is examined and corrosion resistance is evaluated based on a sodium chloride concentration at which rust does not occur.

In the case of the droplets of high-concentration sodium chloride aqueous solutions, the droplets of the sodium chloride aqueous solutions are caused to adhere and dry, and corrosion arises when the places at which the sodium chloride dried and adhered are exposed in a wetting step thereafter. This testing process is in accordance with the real environment in which salt adheres to the surface of a steel sheet during storage and transportation, the salt deliquesces under a high humidity environment thereafter, and depending on the case, corrosion arises. Since the adhered amount of salt decreases as the sodium chloride concentration decreases, the amount of rust occurrence lessens and ultimately rust is no longer observed. The corrosion resistance of an insulating coating can be quantitatively evaluated based on the sodium chloride concentration of an upper limit at which rust is not observed.

Figure 4:
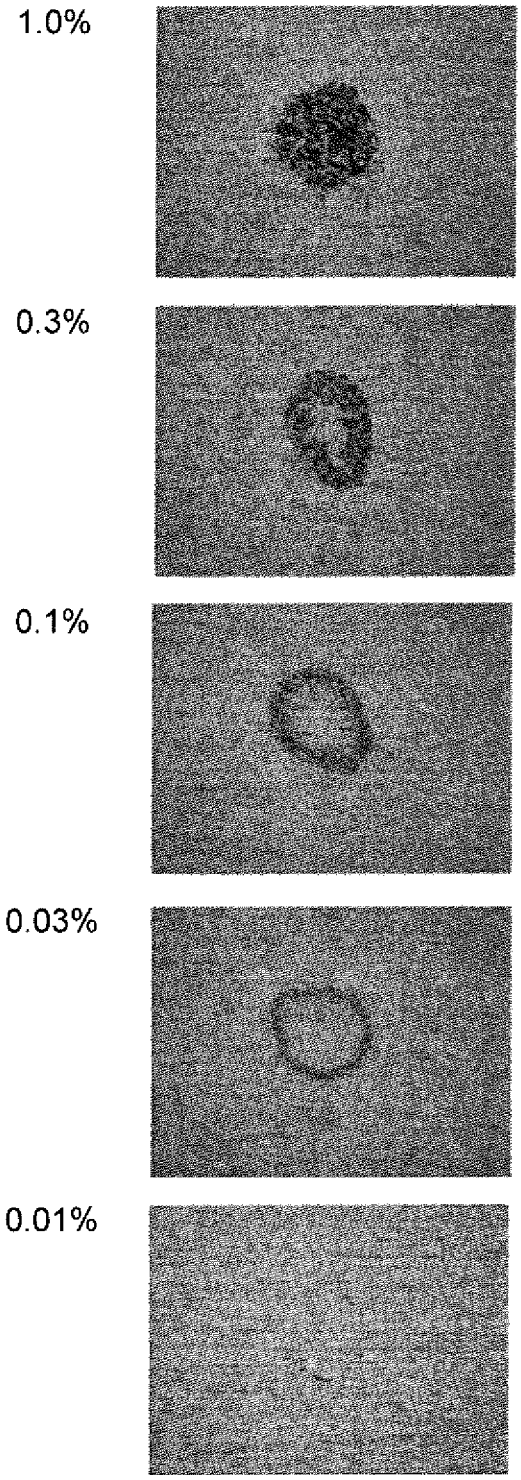
FIG. 4 is a view illustrating an example of an evaluation method of a corrosion resistance test for an insulating coating.

An example of the evaluation method of the corrosion resistance test for an insulating coating is illustrated in FIG. 4. The results shown in FIG. 4 were obtained when the sodium chloride concentration was decreased in decrements of 0.1% from 1.0% to 0.1% and in decrements of 0.01% from 0.1% to 0.01%, and the state of rust occurrence (corrosion state) at each concentration was observed. In the case of the results shown in FIG. 4, since the occurrence of rust is not observed when the sodium chloride concentration is 0.01%, the critical concentration of sodium chloride is 0.01%. Note that, it could be confirmed that this rusting situation hardly changes even if the holding time period in a constant temperature and humidity chamber is extended from 48 hours.

Hereunder, the present invention is described specifically by way of examples, although the present invention is not limited to these examples.

EXAMPLES

Coating liquids containing the components shown in Table 1 were coated onto the surface of an electrical steel sheet having a thickness of 0.5 mm and containing 0.3% by mass of Si and baked under the conditions shown in Table 1 to form an insulating coating on both sides of the electrical steel sheet. Thereafter, the insulating coating structure (presence or absence of an enriched layer) and the enrichment were examined by GDOES and ICP-AES. In addition, the corrosion resistance of the insulating coating and the weldability were evaluated. Table 1 shows a summary of the results. As a comparison, chromate-based insulating coatings were prepared and evaluated in the same manner.

Measurement of the enrichment was carried out by the following method. First, the concentration distribution in the depth direction of P and each metallic component contained in the insulating coating was measured by GDOES. Further, an area framed by a curve indicated by the concentration profile and the ordinate and abscissa was determined with respect to a divalent metal in the enriched layer and a divalent metal in the insulating coating other than the enriched layer, respectively. Note that, in a case where the same divalent metal was contained in the phosphate and in the chelate compound, a peak of the divalent metal originating from the enriched layer approximated by a Gaussian function was separated from the depth-direction profile of the divalent metal in the enriched layer, and the remainder thereof was taken as the divalent metal originating from the phosphate.

Next, by soaking the steel sheet having a predetermined area where the insulating coating was formed on the surface in a 20% NaOH aqueous solution at 80° C. for 30 minutes, only the insulating coating containing the enriched layer was selectively dissolved entirely without dissolving the base metal. Thereafter, the total divalent metal amount (g/m$^2$) contained in the insulating coating per unit area was determined by analyzing the NaOH aqueous solution after the coating film dissolution treatment using inductively coupled plasma atomic emission spectrophotometry (ICP-AES).

The enrichment of the divalent metal contained in the enriched layer was then calculated based on the following formula (i).

$$M_I = M_T \times S_I / (S_I + S_C) \quad \text{(i)}$$

Where, the meaning of each symbol in the formula is as follows:

$M_I$: enrichment (g/m$^2$) of divalent metal contained in the enriched layer;

$M_T$: total divalent metal amount (g/m$^2$) contained in the insulating coating;

$S_I$: area of concentration profile originating from enriched layer; and $S_C$: area of concentration profile originating from insulating coating excluding enriched layer.

Evaluation of the corrosion resistance was performed by the following method. A test specimen was cut out from a non-oriented electrical steel sheet on which the insulating coating was formed, droplets (0.5 μL) of sodium chloride aqueous solutions of various concentrations in a range of 0.001 to 1.0% were caused to adhere and dry on the surface of the test specimen, and thereafter the test specimen was held for 48 hours in a chamber that was maintained in a constant temperature and constant humidity state (50° C., RH 90%), and the corrosion state of the surface was then observed. The corrosion resistance was evaluated using the maximum sodium chloride concentration at which rust did not arise as an index.

Further, evaluation of the weldability was performed by the following method. Under conditions of a welding current of 120 A, electrodes La—W (2.4 mmϕ), a gap of 1.5 mm, Ar flow rate of 6 L/min, and clamping pressure of 50 kg/cm$^2$, the welding speed was varied and a maximum welding speed at which blowholes did not arise was determined. The weldability was evaluated using the maximum welding speed in question as an index.

Note that, in the present invention, with respect to the evaluation of the corrosion resistance, the corrosion resistance was evaluated as being excellent in a case where the maximum sodium chloride concentration at which rust did not occur was 0.2% or more.

TABLE 1

| Test No. | Composition of coating liquid: Phosphate | Chelate compound: Type | Chelate compound: m/l[#1] | Resin | Coating condition: Coating amount (g/m$^2$) | Coating condition: Addition amount of divalent metal chelate[#2] (g/m$^2$) | Baking condition First heating: rate of temperature increase (° C./s) |
|---|---|---|---|---|---|---|---|
| 1 | Al phosphate | Zn gluconate | 0.6 | — | 0.5 | 0.01 | 12 |
| 2 | Al phosphate | Ca oxalate | 0.7 | Acrylic | 0.5 | 0.02 | 12 |
| 3 | Mg phosphate | Mg phosphonate | 0.1 | Acrylic | 0.5 | 0.03 | 12 |
| 4 | Zn phosphate | Ca citrate | 0.5 | Aacrylic styrene | 0.5 | 0.03 | 10 |
| 5 | Al phosphate + Mg phosphate | Zn phosphonate | 0.4 | Polyester | 0.5 | 0.05 | 12 |
| 6 | Al phosphate + Zn phosphate | Sr gluconate | 0.5 | Epoxy | 0.5 | 0.1 | 12 |
| 7 | Al phosphate | Ca phosphonate | 0.9 | Acrylic | 0.5 | 0.2 | 12 |
| 8 | Al phosphate | — | — | — | 2 | 0 | 12 |
| 9 | Al phosphate | — | — | Acrylic | 2 | 0 | 12 |
| 10 | Mg phosphate | — | — | Acrylic | 1 | 0 | 12 |
| 11 | Al phosphate | — | — | Acrylic + copolymer of a fluoroolefin and an ethylenically unsaturated compound | 2 | 0 | 12 |
| 12 | Al phosphate | Mg gluconate | 0.05 | Acrylic | 1 | 0.1 | 12 |
| 13 | Mg phosphate | Ca phosphonate | 1 | Acrylic | 1 | 0.1 | 8 |
| 14 | Mg phosphate | Sr oxalate | 0.2 | Acrylic | 1 | 0.008 | 12 |
| 15 | Al phosphate | Ca phosphonate | 0.2 | Acrylic | 1 | 0.1 | 12 |
| 16 | Al phosphate + Mg phosphate | Mg citrate | 0.2 | Acrylic | 1 | 0.1 | 12 |
| 17 | Al phosphate | Mg gluconate | 0.5 | Acrylic | 0.5 | 0.1 | 8 |
| 18 | Mg phosphate | Mg gluconate | 0.5 | Acrylic | 0.5 | 0.1 | 8 |
| 19 | Al phosphate | gluconic acid + Mg hydroxide | 0.5 | Acrylic | 0.5 | 0.1 | 12 |
| 20 | Mg phosphate | gluconic acid + Mg hydroxide | 0.5 | Acrylic | 0.5 | 0.1 | 12 |
| 21 | Mg chromate* | — | — | Acrylic | 0.5 | 0 | 12 |

| Test No. | Baking condition: Second rate of temperature increase (° C./s) | Baking condition: Reaching temperature (° C.) | Coating structure Enrichment of the divalent metal (g/m$^2$) | Test result: Corrrosion[#3] resistance | Test result: Weldability[#4] (cm/min) | |
|---|---|---|---|---|---|---|
| 1 | 10 | 300 | 0.01 | 0.20% | 100 | Inventive example |
| 2 | 8 | 300 | 0.02 | 0.30% | 100 | |
| 3 | 10 | 300 | 0.03 | 0.40% | 100 | |
| 4 | 8 | 200 | 0.03 | 0.60% | 100 | |
| 5 | 10 | 250 | 0.05 | 0.80% | 100 | |
| 6 | 10 | 350 | 0.1 | 1.00% | 100 | |
| 7 | 10 | 300 | 0.2 | 1.00% | 100 | |
| 8 | 10 | 300 | 0* | 0.02% | 50 | Comparative example |
| 9 | 10 | 300 | 0* | 0.02% | 50 | |
| 10 | 20 | 300 | 0* | 0.01% | 100 | |
| 11 | 10 | 300 | 0* | 0.03% | 50 | |
| 12 | 10 | 300 | 0.001* | 0.01% | 100 | |
| 13 | 5 | 300 | 0.001* | 0.01% | 100 | |
| 14 | 10 | 300 | 0.008* | 0.01% | 100 | |
| 15 | 15 | 300 | 0.001* | 0.01% | 100 | |
| 16 | 15 | 300 | 0.001* | 0.02% | 100 | |
| 17 | 8 | 300 | 0.001* | 0.02% | 100 | |
| 18 | 8 | 300 | 0.001* | 0.02% | 100 | |
| 19 | 10 | 300 | 0.001* | 0.02% | 100 | |

TABLE 1-continued

| | | | | | |
|---|---|---|---|---|---|
| 20 | 10 | 300 | 0.001* | 0.02% | 100 |
| 21 | 10 | 300 | 0* | 0.20% | 100 |

*indicates that conditions do not satisfy those defined by the present invention.
#1indicates compounding ratio of an addition amount m (mol) of the divalent metal to an addition amount l(mol) of the chelate component
#2indicates values converted to amounts of divalent metal
#3indicates maximum sodium chloride concentration at which rust did not arise
#4indicates maximum welding speed at which blowholes did not arise Based on Table 1, it is found that the corrosion resistance is markedly superior in test numbers 1 to 7 that are Inventive Examples of the present invention. In the Inventive Examples of the present invention, with a thin film thickness of 0.5 g/m$^2$ (approximately 0.2 μm), that is, a film thickness of the same level as the film thickness of a chromate-based insulating coating, it is possible to secure excellent corrosion resistance that is equal to or better than the corrosion resistance of a chromate-based insulating coating. In addition, it is found that because the film thickness can be made thin, the weldability is also equal to the weldability of the conventional chromate-based insulating coating.

In contrast, with respect to test numbers 8 to 11 as Comparative Examples in which a chelate compound was not added to the coating liquid, because an enriched layer of a divalent metal was not formed, even though the thickness of the insulating coating was made thick, the results showed that the corrosion resistance was poor. In addition, with regard to test numbers 8, 9 and 11, because the film thickness was thick, the results indicated poor weldability.

In test numbers 12 and 13, because the values for the compounding ratio m/l of the chelate compound were too small and too large, respectively, the enrichment was insufficient. In test number 14, because the added amount of the chelate compound in the coating liquid was insufficient, the enrichment was insufficient. In addition, in test numbers 15 to 18, because the temperature increase conditions during baking were inappropriate, the enrichment was insufficient.

Further, in test numbers 19 and 20, because the divalent metal and the chelate component were added separately to the phosphate aqueous solution, the enrichment was insufficient. In each of test numbers 12 to 20 in which the enrichment was insufficient, the results showed the corrosion resistance to be poor.

Figure 5:
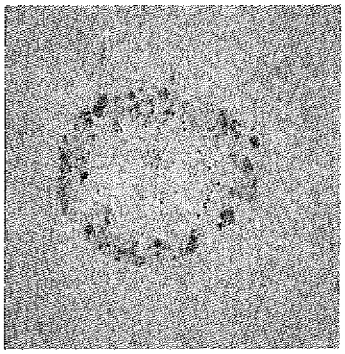
FIG. 5 is a view showing an example of results of a corrosion resistance test on an insulating coating, in which (a) shows a result obtained by using a sodium chloride aqueous solution with a sodium chloride concentration of 0.03% to evaluate the corrosion resistance of an insulating coating formed without adding a chelating agent to an aluminum phosphate, and (b) shows a result obtained by using a sodium chloride aqueous solution with a sodium chloride concentration of 0.2% to evaluate the corrosion resistance of an insulating coating formed by adding a chelating agent to an aluminum phosphate.
Figure 5:
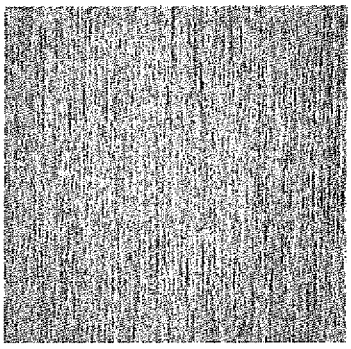

An example of results obtained by using the aforementioned corrosion resistance test to investigate the influence that a divalent metal enriched layer that is present in the vicinity of an interface with the base metal has on corrosion resistance of an insulating coating is shown in FIG. 5. FIG. 5(*a*) shows a result obtained by using a sodium chloride aqueous solution having a sodium chloride concentration of 0.03% to evaluate the corrosion resistance of the insulating coating in test number 8 that was formed without adding a chelate compound to aluminum phosphate. FIG. 5(*b*) shows a result obtained by using a sodium chloride aqueous solution having a sodium chloride concentration of 0.2% to evaluate the corrosion resistance of the insulating coating in test number 1 that was formed by adding a chelate compound containing Zn as a divalent metal to aluminum phosphate.

In the case of the insulating coating formed without adding a chelate compound to the aluminum phosphate, a large amount of rust occurred in the sodium chloride aqueous solution having a sodium chloride concentration of 0.03%. On the other hand, in the case of the insulating coating formed by adding the chelate compound containing Zn as a divalent metal to the aluminum phosphate, almost no rust arose in the sodium chloride aqueous solution having a sodium chloride concentration of 0.2%.

Further, FIGS. 6 to 11 are views that illustrate results of depth analysis with respect to test numbers 9, 10, 15 and 20 as Comparative Examples and test numbers 2 and 3 as Inventive Examples of the present invention, respectively.

Figure 6:
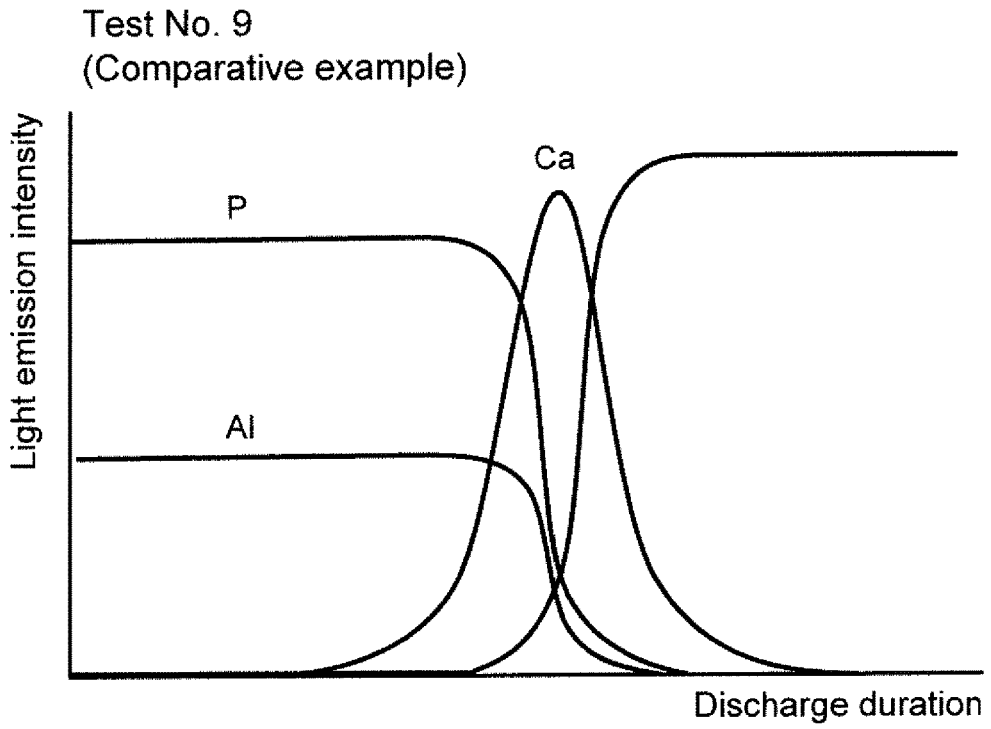
FIG. 6 is a graph illustrating an element concentration distribution in a coating thickness direction in test number 9 of the Examples.
Figure 7:
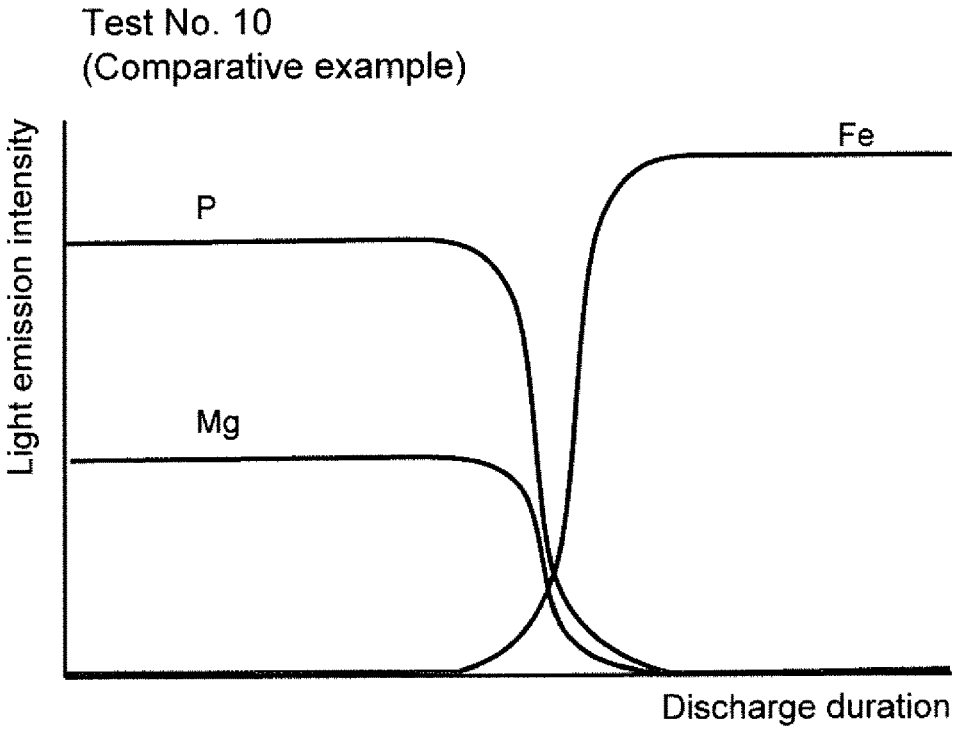
FIG. 7 is a graph illustrating an element concentration distribution in a coating thickness direction in test number 10 of the Examples.
Figure 8:
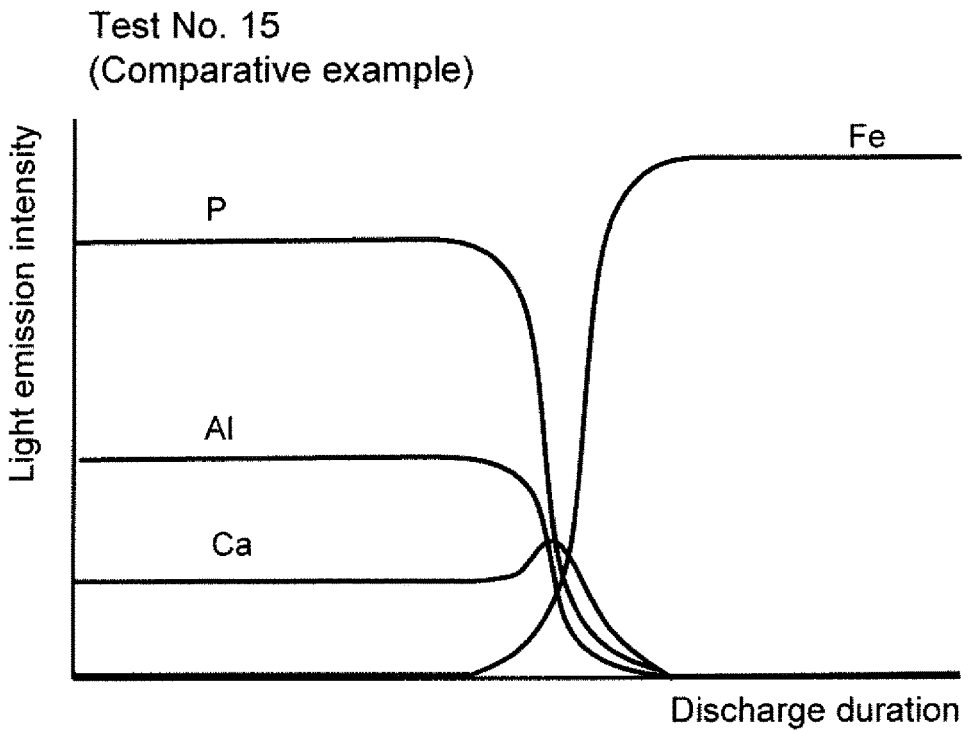
FIG. 8 is a graph illustrating an element concentration distribution in a coating thickness direction in test number 15 of the Examples.
Figure 9:
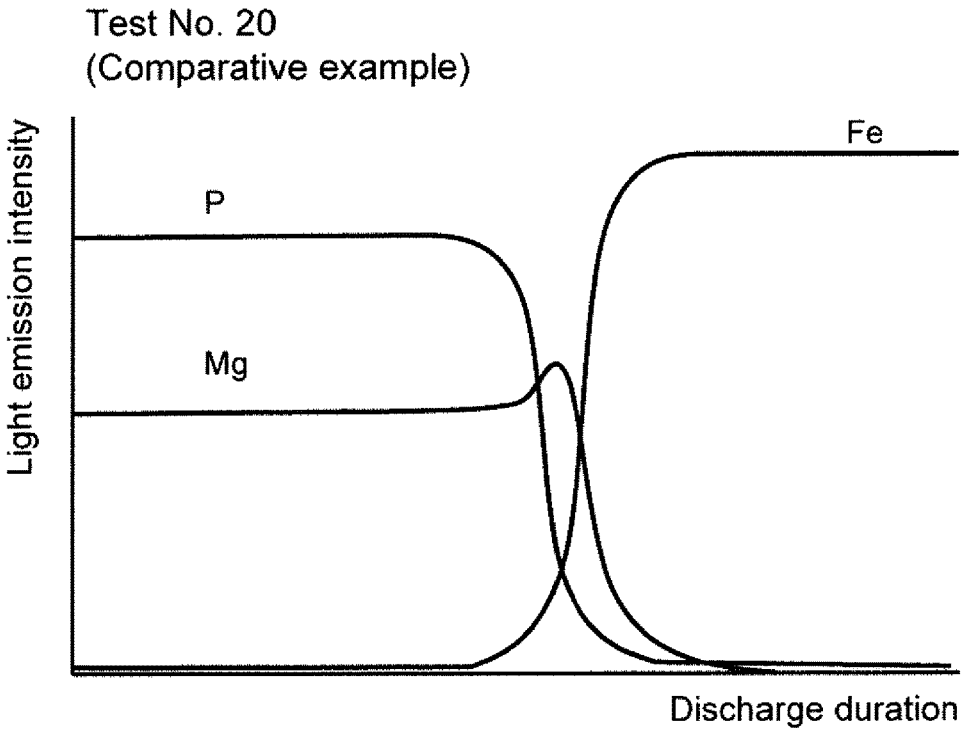
FIG. 9 is a graph illustrating an element concentration distribution in a coating thickness direction in test number 20 of the Examples.

In test numbers 9 and 10 in which a chelate compound was not added into the coating liquid, as illustrated in FIGS. 6 and 7, a peak of a divalent metal was not observed. Further, in test numbers 15 and 20 in which, although a chelate compound was added, the production conditions were not appropriate, as illustrated in FIGS. 8 and 9, although a peak of a divalent metal was observed, the peak was very small.

Figure 10:
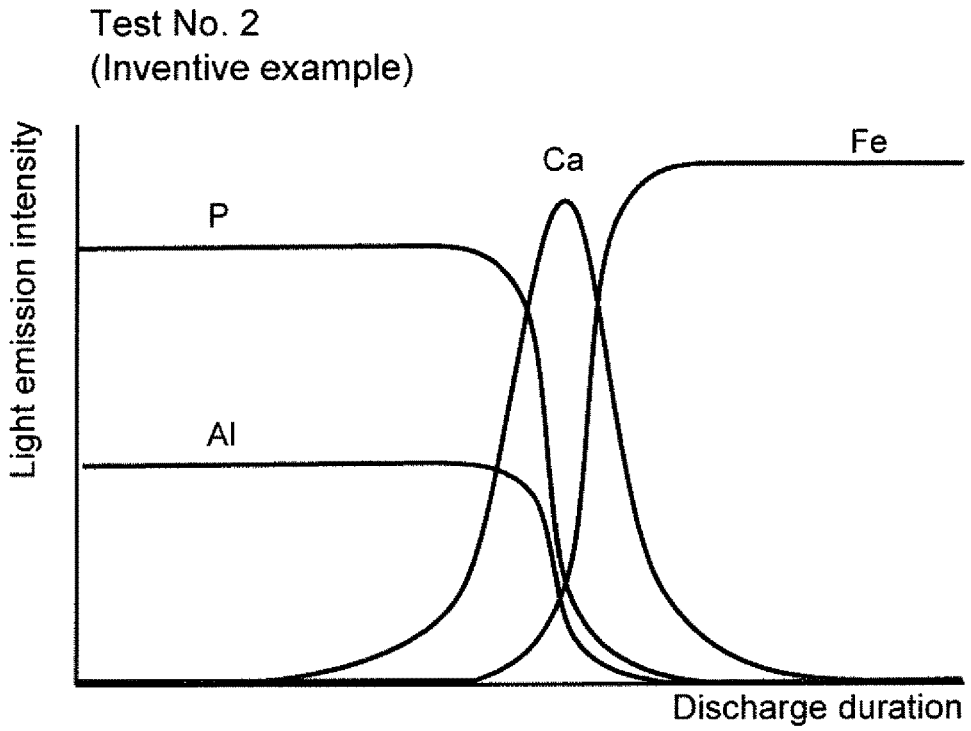
FIG. 10 is a graph illustrating an element concentration distribution in a coating thickness direction in test number 2 of the Examples.
Figure 11:
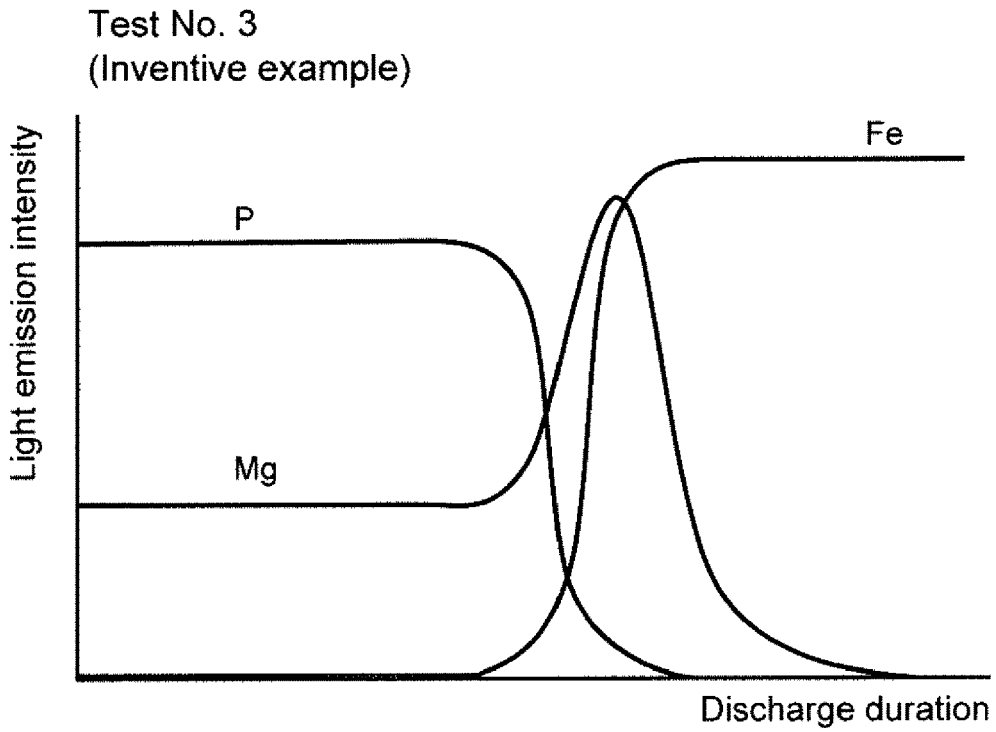
FIG. 11 is a graph illustrating an element concentration distribution in a coating thickness direction in test number 3 of the Examples.

In contrast to the foregoing Comparative Examples, in test numbers 2 and 3 that satisfied the conditions specified by the present invention, as illustrated in FIGS. 10 and 11, a peak of a divalent metal could be clearly confirmed.

INDUSTRIAL APPLICABILITY

According to the present invention, because excellent corrosion resistance can be secured even with a film thickness of the same level as the film thickness of a chromate-based insulating coating, an environment-friendly insulation coating for an electrical steel sheet that is excellent in weldability and interlocking performance can be obtained. Accordingly, an electrical steel sheet on which an insulating coating according to the present invention is formed is suitable for use in a high air-borne salt environment during marine transportation and in high-temperature and high-humidity environments corresponding to subtropical regions and tropical regions.

What is claimed is:

1. An insulating coating for an electrical steel sheet that is formed on a surface of a base metal of the electrical steel sheet, wherein the insulating coating comprises a polyvalent metal phosphate of one or more elements selected from Al, Zn, Mg and Ca, and the insulating coating has an enriched layer of a divalent metal at an interface with the surface of the base metal, wherein an enrichment of the divalent metal contained in the enriched layer is 0.01 g/m$^2$ or more and less than 0.2 g/m$^2$.

2. The insulating coating for an electrical steel sheet according to claim 1, wherein the insulating coating further contains an organic resin.

* * * * *